US010976688B2

(12) United States Patent
Nir et al.

(10) Patent No.: US 10,976,688 B2
(45) Date of Patent: Apr. 13, 2021

(54) INK DOSING

(71) Applicant: HP INDIGO B.V., Amstelveen (NL)

(72) Inventors: Jonathan Nir, Ness Ziona (IL); Yossi Shachak, Kfar Saba (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/607,188

(22) PCT Filed: Sep. 6, 2017

(86) PCT No.: PCT/EP2017/072341
§ 371 (c)(1),
(2) Date: Oct. 22, 2019

(87) PCT Pub. No.: WO2019/048035
PCT Pub. Date: Mar. 14, 2019

(65) Prior Publication Data

US 2020/0387088 A1 Dec. 10, 2020

(51) Int. Cl.
*B41J 2/175* (2006.01)
*G03G 15/10* (2006.01)
*B41J 2/21* (2006.01)

(52) U.S. Cl.
CPC ..... *G03G 15/105* (2013.01); *B41J 2/17506* (2013.01); *B41J 2/21* (2013.01)

(58) Field of Classification Search
CPC ..... B41J 2/17506
See application file for complete search history.

(56) References Cited

U.S. PATENT DOCUMENTS

| | | | | |
|---|---|---|---|---|
| 4,738,134 | A * | 4/1988 | Hauer | B41F 31/00 73/149 |
| 5,713,062 | A | 1/1998 | Goodman et al. | |
| 6,263,171 | B1 | 7/2001 | Oyamada | |
| 7,556,326 | B2 | 7/2009 | Knierim et al. | |
| 7,614,727 | B2 | 11/2009 | Hori | |
| 9,037,047 | B2 | 5/2015 | Sandler et al. | |
| 9,535,363 | B2 | 1/2017 | Schlumm et al. | |
| 2007/0146448 | A1 * | 6/2007 | Chung | B41J 2/17506 347/86 |

FOREIGN PATENT DOCUMENTS

| | | |
|---|---|---|
| JP | 2001125383 | 4/2001 |
| WO | WO-2016190449 | 12/2016 |
| WO | WO-2017020916 | 2/2017 |

* cited by examiner

*Primary Examiner* — Sharon Polk
(74) *Attorney, Agent, or Firm* — Garry A. Perry

(57) ABSTRACT

In one example of the disclosure, a first measurement of actual quantity of ink in a target cartridge is taken utilizing a scale. An incremental dosage quantity be deposited into the target cartridge in a dosing pass is determined based upon a desired quantity, the actual quantity, and an undershoot safety factor. A valve is opened to enable a pressure deposit of the incremental dosage quantity of ink to the target cartridge, and then closed. A residue cutter is utilized to scrape the valve and thereby make a scraper deposit of ink to the target cartridge. A second measurement of actual quantity of ink in the target cartridge is taken utilizing the scale. An additional dosage pass is performed if the second measurement is not within an accepted variance of the desired quantity. The making of dosing passes is discontinued if the second measurement is within the accepted variance.

15 Claims, 7 Drawing Sheets

INK DOSING

BACKGROUND

Liquid electrophotography ("LEP") printing processes include creating an electrostatic pattern of a desired printed image on a charged photoconductor and developing the image by presenting a thin layer of electrostatic LEP ink to the photoconductor. The charged LEP ink may be presented to the charged photoconductor utilizing a developer roller. The charged toner particles in the LEP ink adhere to the pattern of the desired image on the oppositely charged photoconductor. The ink image is then transferred from the photoconductor to a paper or other print substrate. In examples, a combination of heat and pressure may be utilized to transfer the ink image as an ink film from the photoconductor to an intermediate transfer member ("ITM"), with the ink film being subsequently transferred from the ITM to the print substrate.

DRAWINGS

DETAILED DESCRIPTION

Figure 1:
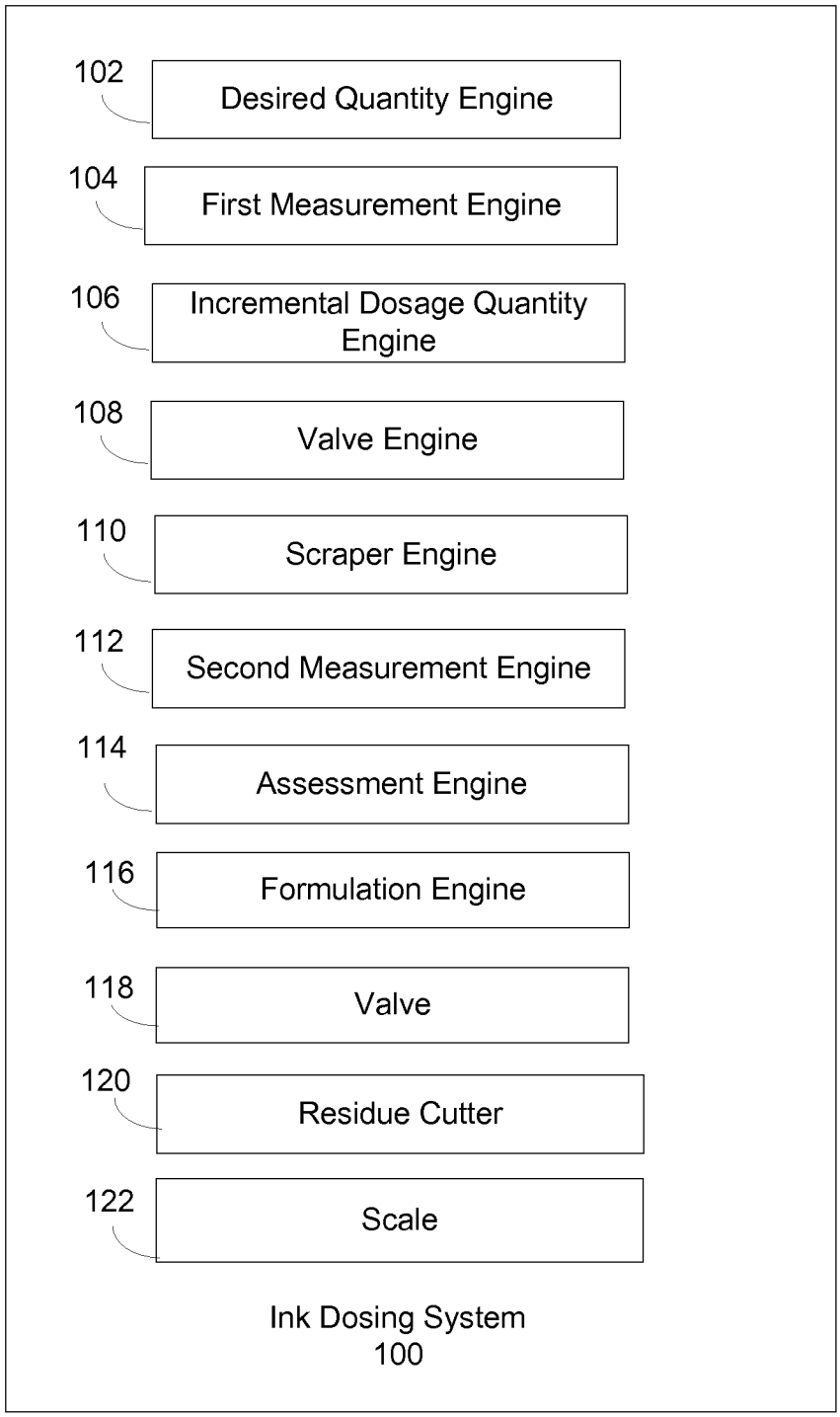
FIG. 1 illustrates an example of an ink dosing system.

Typically, LEP inks are manufactured as concentrated pastes that include a mixture of ink pigments, resin, and carrier liquid. In examples, LEP inks may be manufactured by methods in which polymer particles dispersed in an amount of liquid vehicle are ground (before and/or after the addition of a colorant) until the achievement of a target median particle size or viscosity. When it is time for printing, the LEP ink concentrate from a cartridge that has been inserted at the press can be diluted by adding a sufficient quantity of a carrier liquid or other additives to form the LEP ink.

Many LEP printing devices are designed to hold cartridges for cyan, magenta, yellow, black (CMYK) LEP concentrated inks. The printing device may combine diluted CMYK inks to form an array of colors including specialty inks at the printing device. A specialty concentrated ink may be one that is manufactured to a specific Pantone or other specific color formulation by mixing other inks (e.g., mixing at least two from the set of cyan, magenta, yellow, black, white, and n custom colors) that meet a customer's requirements. In some situations, however, e.g., where a very high accuracy is needed for a particular color (e.g., a trademark or logo color), or where a large amount of the specialty is needed, it may be preferable to utilize at the printing device or press (hereinafter referred to as a "press") a spot color cartridge of a specialty concentrated ink prepared off-press rather than utilizing an on-press CMYK formulation. As used herein, a spot color, (as in a spot color ink or a spot color formulation) refers generally to a premixed ink that it usable at a press instead of, or in addition to, on-press mixtures of CMYK inks. Certain LEP printing devices have ink stations capable of holding several such spot color cartridges.

For instance a customer that desires to create a proprietary red concentrated spot color ink may choose to mix a Pantone 032 U Red and Pantone 485C red so as to achieve higher color accuracy than what could be done using CMYK at the press. However, distributing the highly viscous LEP ink in precise volumes with existing equipment has been a difficult task. Overshooting a prescribed amount of an ink is common when creating spot color inks, and the resulting waste batches can significantly affect a customer's satisfaction with LEP inks and presses.

To address these issues, various examples described in more detail below provide a system and method that enables automatic dosing of high viscosity LEP inks utilizing source ink cartridges. In an example, a system for accurate dosing of concentrated LEP ink includes a valve, for releasing ink from a removable source ink cartridge into a removable target cartridge, a residue cutter, a scale, and a dosing engine. The dosing engine is to perform a dosing operation by, for each of n dosing passes, causing a first measurement of actual quantity of ink then included in the target cartridge utilizing the scale. For each of n dosing passes the dosing engine is to determine an incremental dosage quantity to be deposited into the target cartridge in that dosing pass based upon a desired quantity of ink to be deposited into the target cartridge, the then-current measured actual quantity of ink in the target cartridge, and an undershoot safety factor for that dosing pass. In examples, the amount of the undershoot safety factor for each dosing pass is determined utilizing a logarithmic function, where according to such function as incremental dosage quantity increases the associated undershoot safety factor to be applied decreases.

For a given dosing pass, following the determination of the incremental dosage quantity the dosing engine causes the valve to open and thereby enable a pressure deposit of the incremental dosage quantity of ink to the target cartridge. The dosing engine then, for the given dosing pass, causes the valve to close and utilizes the residue cutter to scrape the valve and make a scraper deposit of ink to the target cartridge.

For the given dosing pass, the dosing engine next causes a second measurement of actual quantity of ink in the target cartridge to be made utilizing the scale. The dosing engine then determines whether the second measurement is within an accepted variance of the desired quantity of ink to be in the target cartridge. If the second measurement is not within the accepted variance, the dosing engine causes an additional dosage pass to be performed. If the second measurement is within the accepted variance, the dosing engine causes a termination of the dosing operation.

Users of the disclosed dosing system and method will appreciate the ability to automatically and accurately conduct off-press mixing of high viscosity inks. Users will be able to utilize readily available source ink cartridges to create and store spot color formulations in target ink cartridges. Further, users of the disclosed system and method will appreciate the substantial cost savings associated with eliminating or reducing product waste and lost time associated with errors in ink dosing. Providers of printing devices and printing supplies will likewise appreciate the competitive benefits of offering the dosing formation system and method described herein.

FIG. 1 depicts an example of an ink dosing system. In FIG. 1 various components are identified as engines 102, 104, 106, 108, 110, 112, 114, and 116. In describing engines 102-116 focus is on each engine's designated function. However, the term engine, as used herein, refers generally to hardware and/or programming to perform a designated function. As is illustrated with respect to FIG. 3, the hardware of each engine, for example, may include one or both of a processor and a memory, while the programming may be code stored on that memory and executable by the processor to perform the designated function.

In the example of FIG. 1, ink dosing system 100 includes a desired quantity engine 102, a first measurement engine 104, an incremental dosage quantity engine 106, a valve engine 108, a scraper engine 110, a second measurement engine 112, an assessment engine 114, and a formulation engine 116. In performing their respective functions, engines 102-116 may access a data repository, e.g., a memory accessible to system 100 that can be used to store and retrieve data. As illustrated in FIG. 1, system 100 for ink dosing also includes a valve 118, a residue cutter 120, and a scale 122.

In the example of FIG. 1, desired quantity engine 102 represents generally a combination of hardware and programming to, for each of n passes of a mixing operation, cause an access of data indicative of a desired quantity of ink to be deposited into a removable target cartridge. As used herein a "cartridge" refers generally to a container for holding a quantity of ink and for insertion into a printing press or other printing mechanism. In examples, a cartridge may be in the form of a tube, a cylinder, or any other type of container. As used herein an "ink" refers generally to any fluid that is to be applied to a media during a printing operation to form an image upon the media. In examples, the ink may be a highly viscous electrostatic ink utilized in LEP printing. Whereas certain inks used for inkjet or piezo printing may have a viscosity of approximately 1 cP to 50 cP, certain LEP electrostatic inks may have a viscosity of approximately $10^6$ cP to $10^7$ cP. It should be noted that for all viscosity measurements herein, unless otherwise stated, 25° C. is the temperature that is used. Such viscosities can be measured using an Anton Paar Rheometer or a CAP2000 rheometer from Brookfield Instruments.

First measurement engine 104 represents generally a combination of hardware and programming to, for each of the n passes of the mixing operation, cause taking of a first measurement of an actual quantity of ink then-present within a target cartridge. The measured quantity of ink at the target cartridge may be ink that was deposited by ink dosing system 100 into the target cartridge from source cartridges during previous passes of the mixing operation. A scale 122 is utilized to measure the amount of preexisting ink in the target cartridge. A "scale" refers generally to any instrument for weighing, including, but not limited to a high-precision digital scale utilizing strain gauge load cells.

Incremental dosage quantity engine represents generally a combination of hardware and programming to, for each n dosing passes, determine an incremental dosage quantity that is to be deposited into the target cartridge in the dosing pass. The incremental dosage quantity is determined based upon the desired quantity provided by the desired quantity engine 102, the actual quantity that was caused to be measured by the first measurement engine 104, and an undershoot safety factor.

Figure 2:
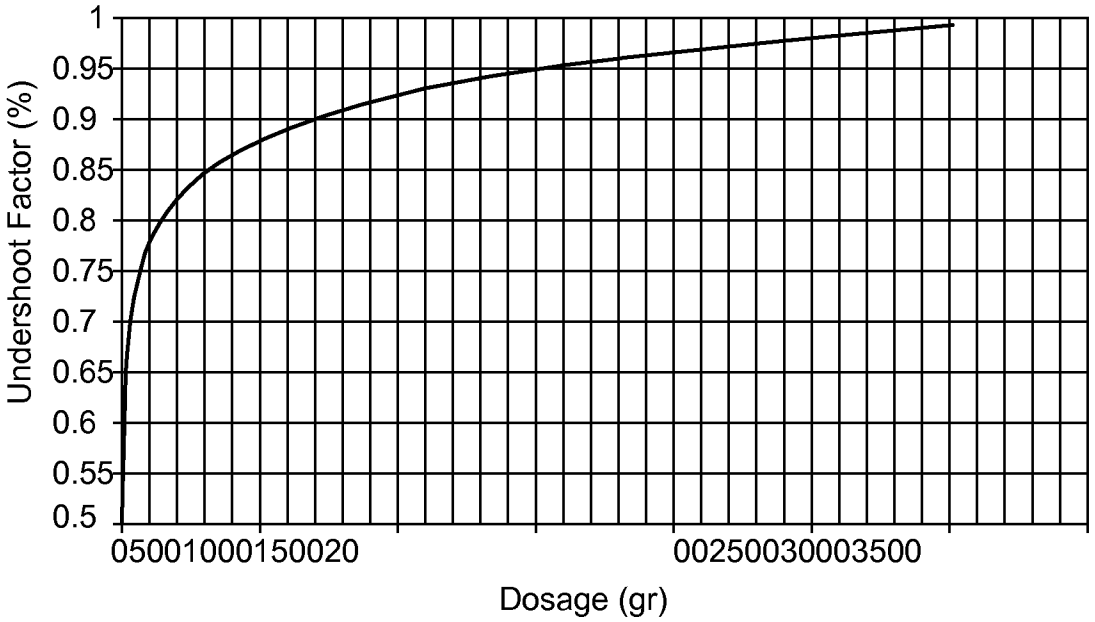
FIG. 2 illustrates examples of undershoot dose safety factors determined according to incremental dosage quantities.

Moving to FIG. 2, in an example for a given dosing pass n, the undershoot safety factor may be expressed as a percentage of the dosing pass, where the amount of ink to be transferred to the target cartridge according to the dosing pass is equal to the difference between the desired quantity for the target cartridge after the dosing pass and the actual measured quantity of ink in the target cartridge immediately prior to the dosing pass. In an example, the amount of the undershoot safety factor may be defined for each dosing pass by a logarithmic function, wherein in according to the logarithmic such function the amount of the calculated undershoot safety factor to be applied decreases as the incremental dosage quantity amount increases. In a particular example, the undershoot safety factor may be expressed by a formula $y=0.06\ln(x)+0.5$, where y is the amount of the undershoot percentage and x is the projected dose.

Returning to FIG. 1, valve engine 108 represents generally a combination of hardware and programming to, for each n dosing passes, cause opening of a valve 118 at ink dosing system 100 to enable a pressure deposit of the incremental dosage quantity of ink from a the source ink cartridge to the target cartridge. As used herein, "valve" refers generally to any device for controlling one-way delivery of ink from one container to another container, e.g., through a pipe or a tube. In examples, the valve may be, but is not limited to, a ball valve, butterfly valve, or a diaphragm valve. In examples, the deposit may be a pressure deposit, wherein a lead screw or plunger at ink dosing system 100 is utilized to compress ink in the source ink cartridge to cause the ink to pass through the regulated valve. In other examples, other means of making a deposit of ink from the source ink cartridge through the valve into the target ink cartridge may be utilized and contemplated by this disclosure.

Scraper engine 110 represents generally a combination of hardware and programming to, for each n dosing passes, cause closing of the valve 118. Scraper engine 110 additionally causes a residue cutter 120 at ink dosing system 100 to scrape the valve 118 after the closing of the valve, and thereby make a scraper deposit of ink to the target ink cartridge. Such use of the residue cutter 120 allows for the extraction a very small quantities (e.g., a fraction of gram) when appropriate, and enables for high accuracy in matching actual and predicted ink dosing amounts.

Second measurement engine 112 represents generally a combination of hardware and programming to, for each n dosing passes, cause a second measurement of actual quantity of ink in the target cartridge utilizing scale 122. The second measurement reflects the actual amount of ink contained in the target cartridge after completion of the dosing pass.

Assessment engine 114 represents generally a combination of hardware and programming to, for each n dosing passes, determine whether dosing is complete or additional dosing passes are to be performed. Assessment engine 114 is to cause performing of an additional dosage pass if the second measurement is not within an accepted variance of the desired quantity. Assessment engine 114 is to discontinue the making of dosing passes if the second measurement is within the accepted variance of the desired quantity.

In some examples ink dosing system 100 may include a formulation engine 116. Formulation engine 116 represents generally a combination of hardware and programming to calculate the desired quantity of ink to be according to a user-specified Pantone or other spot color ink. For instance, a user may specify a desire to create off-press a specialized blue spot color ink that is represented by Pantone 287.

Formulation engine 115 may determine, e.g., via accessing a look-up table or formulation service, that pre-press dosing of the following inks at the following ratios will create the desired Pantone 287 spot ink: cyan: 100 (1), magenta: 63 (0.6267), yellow: 0 (0), and black 41 (0.4118). In this example, formulation engine 116 may calculate, for each of the constituent cyan, magenta, and black inks used to create a Pantone 287 spot color, a desired quantity of the constituent inks to be inserted into the target ink cartridge. For example, formulation engine 116 may determine that to make the Pantone 287 spot color, a first desired quantity of x ounces of cyan ink, a second desired quantity of y ounces of magenta ink, and a third desired quantity of z ounces of black ink are to be inserted into the target ink cartridge utilizing the dosing method and system described herein. A discussed later with respect to FIG. 6, utilizing this example of a desired Pantone 287 spot ink dosing system 100 may include and utilize an automatically actuated carousel for alternatively moving cyan, magenta, and black source ink cartridges into alignment with valve 118 such that respective constituent inks may be sequentially released, in multiple doses according to the dosing method and system described herein, through valve 118 into the removable target cartridge.

In the foregoing discussion of FIG. 1, engines 102-116 were described as combinations of hardware and programming. Engines 102-116 may be implemented in a number of fashions. Looking at FIG. 3 the programming may be processor executable instructions stored on a tangible memory resource 330 and the hardware may include a processing resource 340 for executing those instructions. Thus memory resource 330 can be said to store program instructions that when executed by processing resource 340 implement system 100 of FIG. 1.

Memory resource 330 represents generally any number of memory components capable of storing instructions that can be executed by processing resource 340. Memory resource 330 is non-transitory in the sense that it does not encompass a transitory signal but instead is made up of a memory component or memory components to store the relevant instructions. Memory resource 330 may be implemented in a single device or distributed across devices. Likewise, processing resource 340 represents any number of processors capable of executing instructions stored by memory resource 330. Processing resource 340 may be integrated in a single device or distributed across devices. Further, memory resource 330 may be fully or partially integrated in the same device as processing resource 340, or it may be separate but accessible to that device and processing resource 340.

In one example, the program instructions can be part of an installation package that when installed can be executed by processing resource 340 to implement system 100. In this case, memory resource 330 may be a portable medium such as a CD, DVD, or flash drive or a memory maintained by a server from which the installation package can be downloaded and installed. In another example, the program instructions may be part of an application or applications already installed. Here, memory resource 330 can include integrated memory such as a hard drive, solid state drive, or the like.

Figure 3:
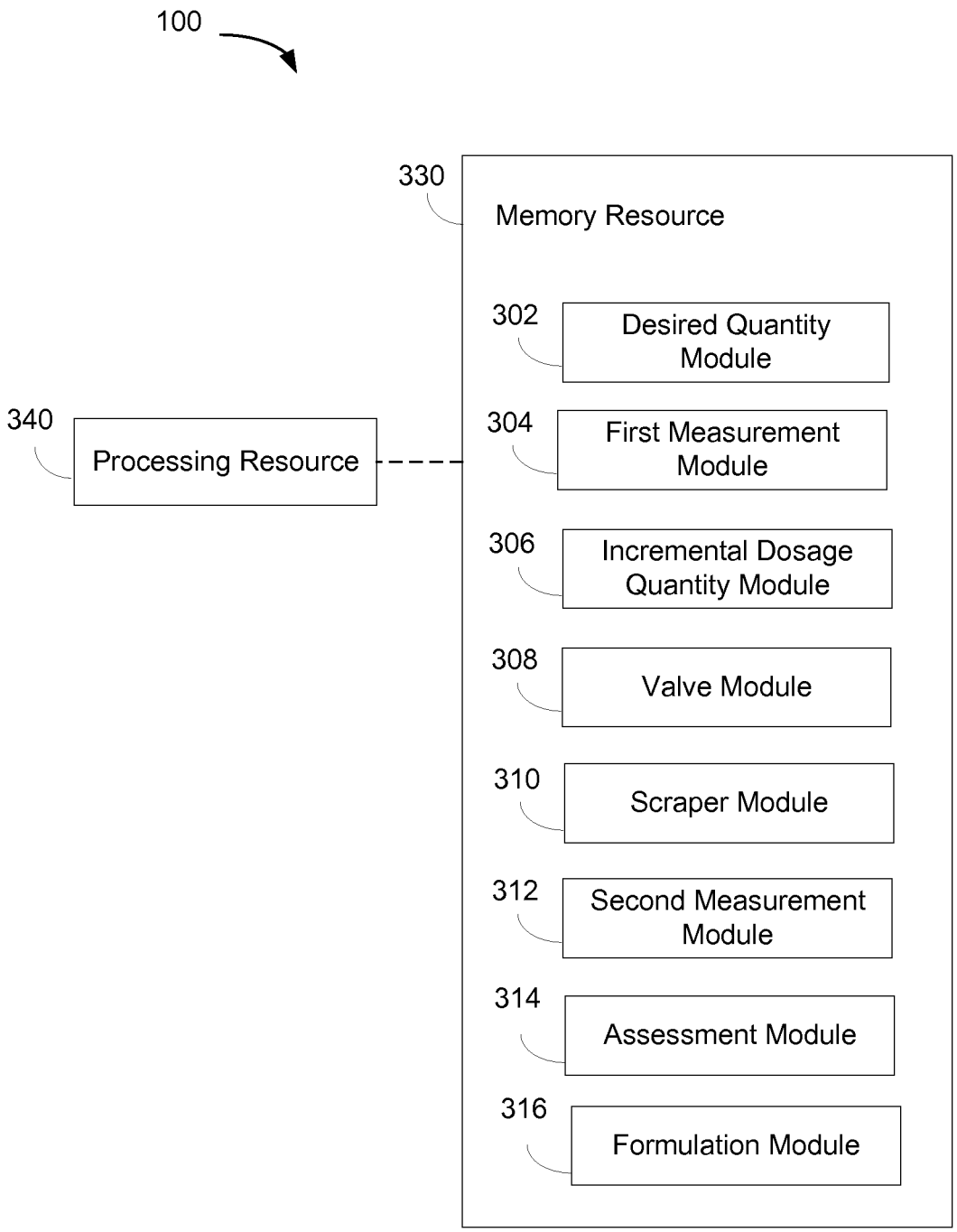
FIG. 3 is a block diagram depicting a memory resource and a processing resource to implement an example of a method for ink dosing.

In FIG. 3, the executable program instructions stored in memory resource 330 are depicted as desired quantity module 302, first measurement module 304, incremental dosage quantity module 306, valve module 308, second measurement module 312, assessment module 314, and formulation module 316. Desired quantity module 302 represents program instructions that when executed by processing resource 340 may perform any of the functionalities described above in relation to desired quantity engine 102 of FIG. 1. First measurement module 304 represents program instructions that when executed by processing resource 340 may perform any of the functionalities described above in relation to first measurement engine 104 of FIG. 1. Incremental dosage quantity module 306 represents program instructions that when executed by processing resource 340 may perform any of the functionalities described above in relation to incremental dosage quantity engine 106 of FIG. 1. Valve module 308 represents program instructions that when executed by processing resource 340 may perform any of the functionalities described above in relation to valve engine 108 of FIG. 1. Scraper module 310 represents program instructions that when executed by processing resource 340 may perform any of the functionalities described above in relation to scraper engine 110 of FIG. 1. Second measurement module 312 represents program instructions that when executed by processing resource 340 may perform any of the functionalities described above in relation to second measurement engine 112 of FIG. 1. Assessment module 314 represents program instructions that when executed by processing resource 340 may perform any of the functionalities described above in relation to assessment engine 114 of FIG. 1. Formulation module 316 represents program instructions that when executed by processing resource 340 may perform any of the functionalities described above in relation to formulation engine 116 of FIG. 1.

Figure 4:
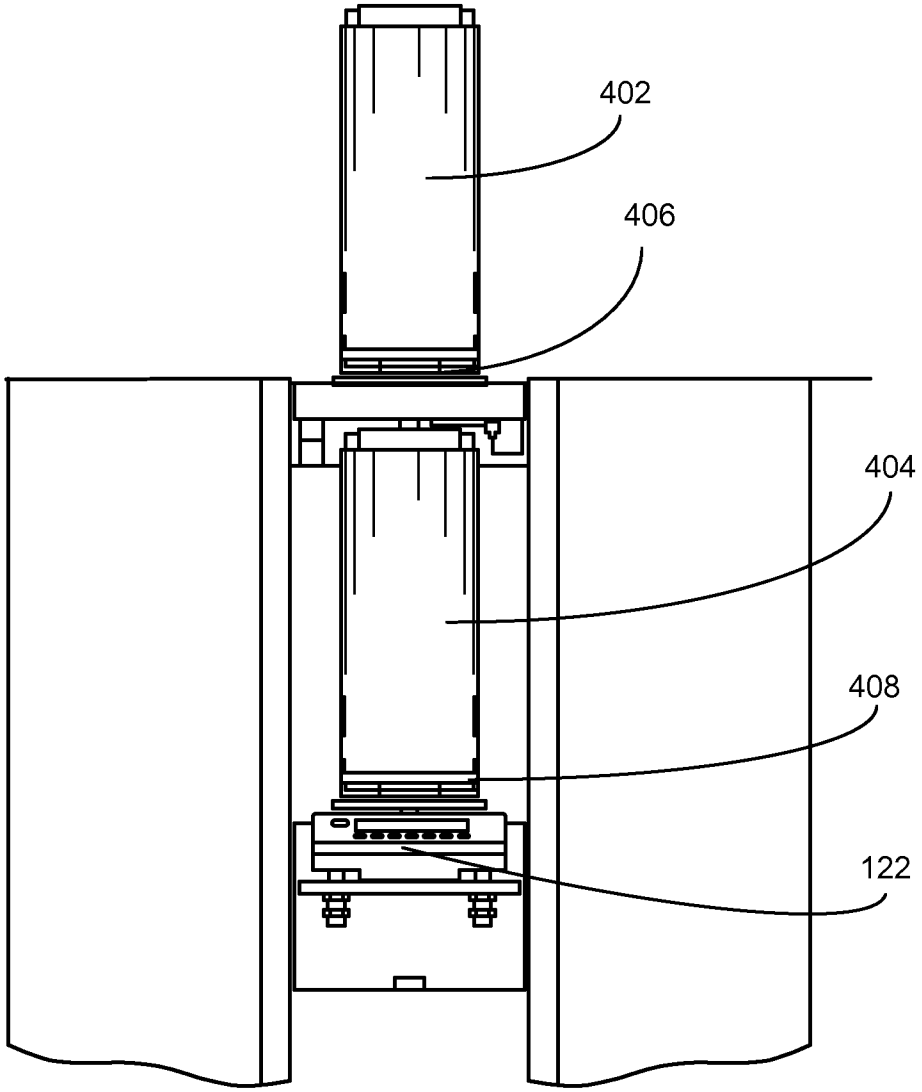
FIG. 4 illustrates a particular example of an ink dosing system.
Figure 4:
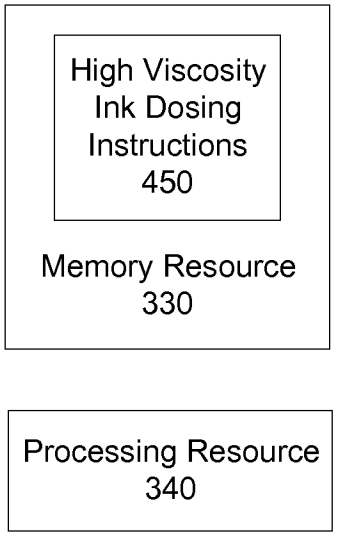

FIG. 4 illustrates a particular example of ink dosing system 100. In this example, system 100 includes a memory resource 330 and a processing resource 340. Memory resource 330 is to store high viscosity ink dosing instructions 450 that when executed by processing resource 340 to enable system 100 to accomplish accurate dosing of high viscosity ink from a removable source cartridge 402 into a removable target cartridge 404.

In this example, source cartridge 402 is situated upon a source cartridge housing apparatus 406 with a snap-in, screw-on, bolt-down or other fastening feature that renders source cartridge 402 easily removable from system 100. Further, target cartridge 404 is situated upon a target cartridge housing apparatus 408 with a snap-in, screw-on, bolt-down or other fastening feature that renders target cartridge 404 easily removable from system 100.

Instructions 450 when executed by processing resource 340 cause system 100 to receive (e.g., as the result of a user instruction or message) or access (e.g., as the result of an accessing of data stored in memory) data indicative of a desired quantity of ink to be deposited from removable source cartridge 402 into removable target cartridge 404.

Continuing at FIG. 4, in this example target cartridge 404 and target cartridge housing 408 rest upon a scale 122 such that it is possible to utilize scale 122 to take measurements of ink amounts inside target cartridge 404. Instructions 450 when executed by processing resource 340 cause system 100 to take a first, pre-dose, measurement of an actual quantity of ink then in target cartridge 404, Instructions 450 when executed by processing resource 340 cause system 100 to determine an incremental dosage quantity that is to be deposited from source cartridge 402 into target cartridge 404 in the dosing pass based upon the desired quantity, the actual quantity, and an applied undershoot safety factor. For instance, if in an example the desired quantity for dosing of a cyan ink is 500 g, and the actual quantity of cyan ink in the target cartridge 404 is known to be 0.0 g as this is a first dosing pass, and the undershoot safety factor that is accessed (e.g., via a look-up table or a undershoot formula such as y=0.06 ln(x)+0.5) is 90%, the determined incremental dosage quantity may be 450 g (500 g*90%). In another example, if in the desired quantity for dosing of a cyan ink is 500 g, and the actual quantity of cyan ink in the target cartridge 404 is known to be 400 g as the result of a measurement using scale 122, and the undershoot safety factor that is accessed (e.g., via a look-up table or a undershoot formula such as y=0.06 ln(x)+0.5) is 90%, the determined incremental dosage quantity may be 90 g ((500 g−400 g)*90%)).

Instructions 450 when executed by processing resource 340 cause system 100 to open a control valve 118 to enable a pressure deposit of the incremental dosage quantity of ink (in this example 450 g) from source cartridge 402 to target cartridge 404. In this example, system 100 the control valve 118 is situated between for source cartridge housing 406 and the opening or top of target cartridge 404. Control valve 118 is to control an ink flow to release ink from removable source cartridge 402 into removable target cartridge 404. The control valve 118 and the residue cutter 120 of system 100 are not visible in the view of FIG. 4.

Figure 5B:
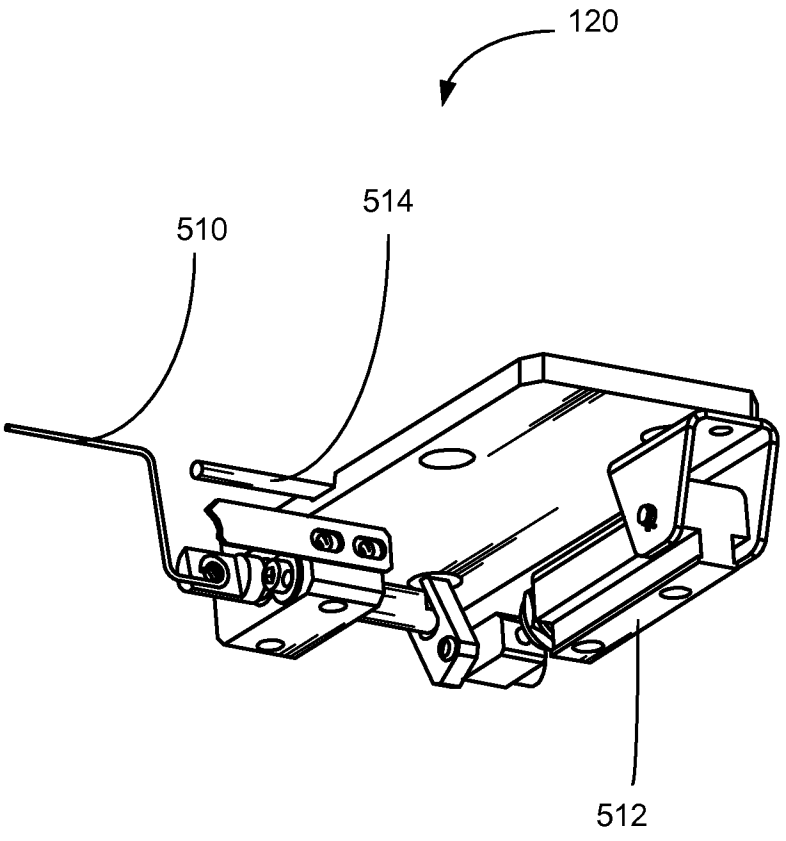
FIGS. 5A and 5B illustrate a particular example of a residue cutter at an ink dosing system.
Figure 5A:
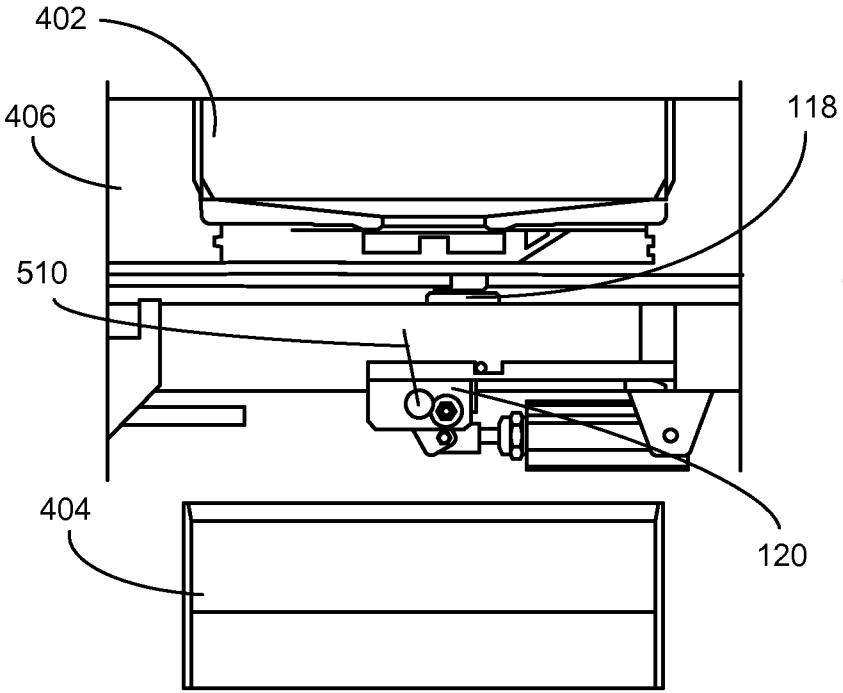

FIG. 5A provides a close-up view of an example of target cartridge housing 408, including control valve 118 and a residue cutter 120. Instructions 450 (FIG. 4) cause system 100 to close control valve 118 and utilize residue cutter 120 to scrape the control valve and thereby make a scraper deposit of cyan ink to target cartridge 404. In examples, system 100 is instructed to close control valve 118 at a point in time such that, after the scraper deposit and with the benefit of the undershoot safety factor, system 100 should be close to the desired amount without having exceeded the desired amount.

FIG. 5B provides an isolated close-up view of the residue cutter 120 of FIG. 5A. In this example, residue cutter 120 includes a rotatable member 510 and a driver component 512. Rotatable member 510 is situated beneath valve 118 (FIG. 5A) in the ink dosing system 100. In this example, rotatable member 510 is a wire member with a simple "S" shape. In other examples rotatable member 510 may be a member other than a wire member, e.g., a wire member with a brush, bristle, or scraping end attachment, or a member without a wire element.

The driver component 512 for residue cutter 120 of FIGS. 5A and 5B includes a pneumatic piston to actuate rotatable member 510. In this example, rotatable member 510 actuated to be rotated in an arc of 180 degrees, so as to achieve a number of positions including a scraping position (so as to scrape ink from the closed valve) and a residue drop position (a position at which ink dropping off the rotatable member, after scraping, and into target cartridge 404 is maximized. In other examples rotatable member 510 may be actuated by a means other than a pneumatic piston, including but not limited to an electrical, hydraulic, or mechanical actuator.

In the example of FIGS. 5A and 5B, instructions 450 when executed cause residue cutter 120 to scrape valve by 412 by causing rotatable member 510 of residue cutter 120 to make a first rotation of approximately 90 degrees in a first rotational direction, followed by a second rotation of approximately 90 degrees in a reverse second rotational direction. In certain examples, instructions 450 when executed by processing resource 340 may cause residue cutter 120 to pause for at least one second between the first rotation of rotatable member 510 and the reverse second rotation of rotatable member 510, so as to encourage dried ink to drop off the rotatable member 510 of residue cutter 120 during the pause period.

Moving to FIG. 5B, in the example of FIGS. 5A and 5B, residue cutter 120 includes an imaging oil tube 514 with a spigot end situated adjacent to rotatable member 510. Imaging oil tube 514 is to be connected to an imaging oil source container. In certain examples, a pumping or extraction of imaging oil from the source container such that a specified quantity imaging oil is applied to rotatable member 510. In this example, the selective imaging oil application operation is to remove dried ink from rotatable member 510 while adding imaging oil to the removable target cartridge 404.

Returning to FIG. 5A, instructions 450 when executed by processing resource 34—, cause ink dosing system 100 to, utilizing scale 122, take a second measurement of actual quantity of ink in target cartridge 404. Ink dosing system 100 is further caused to make a determination as to whether the second measurement is within a predetermined accepted variance of the desired quantity. If the second measurement is within the predetermined accepted variance of the desired quantity, the dosing operation for cyan ink (in this example) terminates. If the second measurement is not within the predetermined accepted variance of the desired quantity, instructions 450 when executed will cause system 100 to perform additional dosage passes as described herein until the amount of ink deposited into the target cartridge 404 is within the acceptable variance of the desired quantity.

Figure 6:
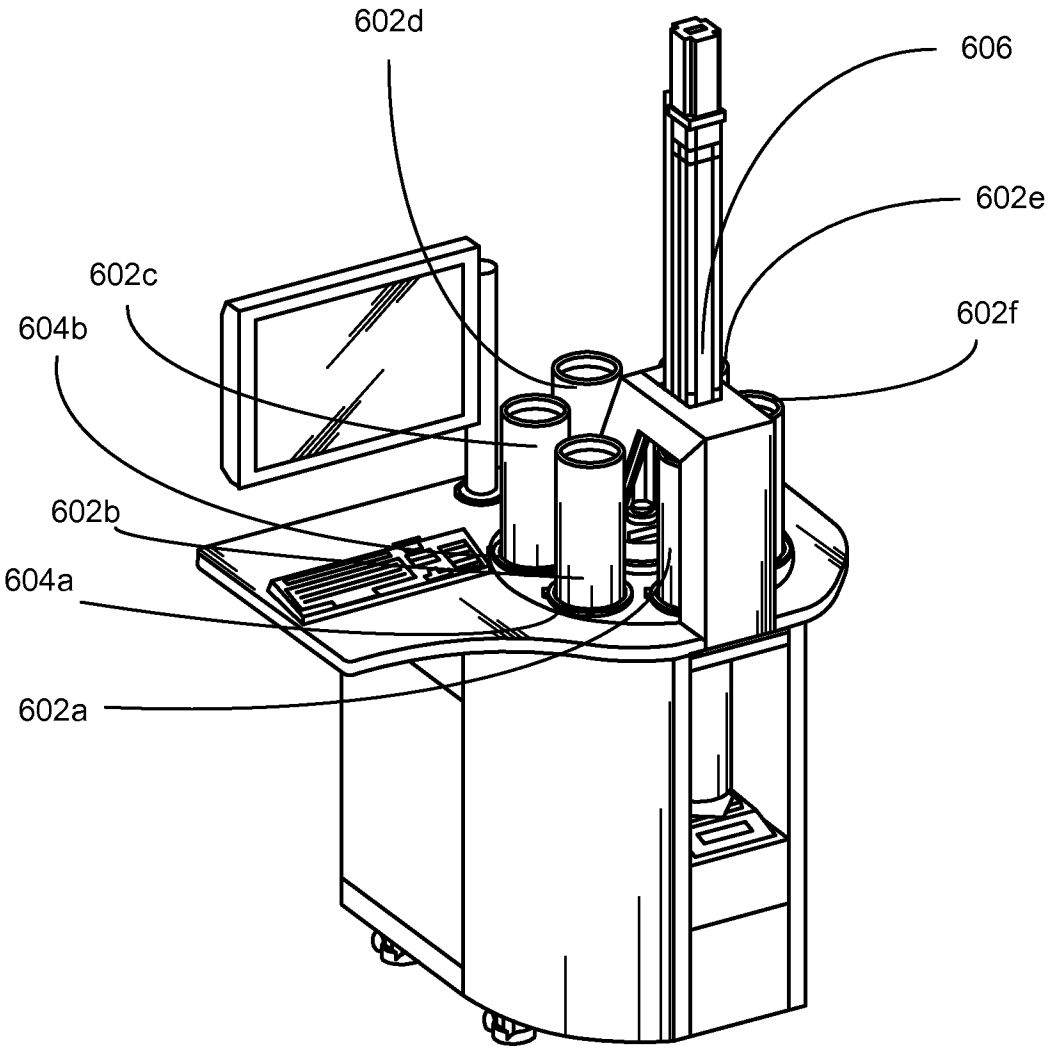
FIG. 6 illustrates another example of an ink dosing system including a carousel for moving source cartridges into alignment

FIG. 6 illustrates another example of an ink dosing system including a carousel for moving source cartridges into alignment. In the example of FIG. 6, ink dosing system 100 includes six source cartridges 602*a*, 602*b*, 602*c*, 602*d*, 602*e*, and 602*f*, with each being situated upon its own source cartridge housing apparatus (see e.g. 604*a* and 604*b*. Each source cartridge housing apparatus has a snap-in, screw-on, bolt-down or other fastening feature such that its respective source cartridge is easily removable from system 100. Each of source cartridges 602*a*-602*f*, and the associated source cartridge housing apparatus, rest upon a carousel that can be rotated horizontally around a vertical axis. The rotation of the carousel is to alternatively move multiple source cartridges, e.g., source cartridges 602*a*-602*f*, as needed into and out of a dosing position. The dosing position is a position wherein a subject source cartridge is into alignment with a valve such that ink may be released from the subject source cartridge through the valve into a removable target cartridge. In this example, release of the ink from the subject source cartridge includes applying pressure to the ink via a lead screw apparatus 606.

Figure 7:
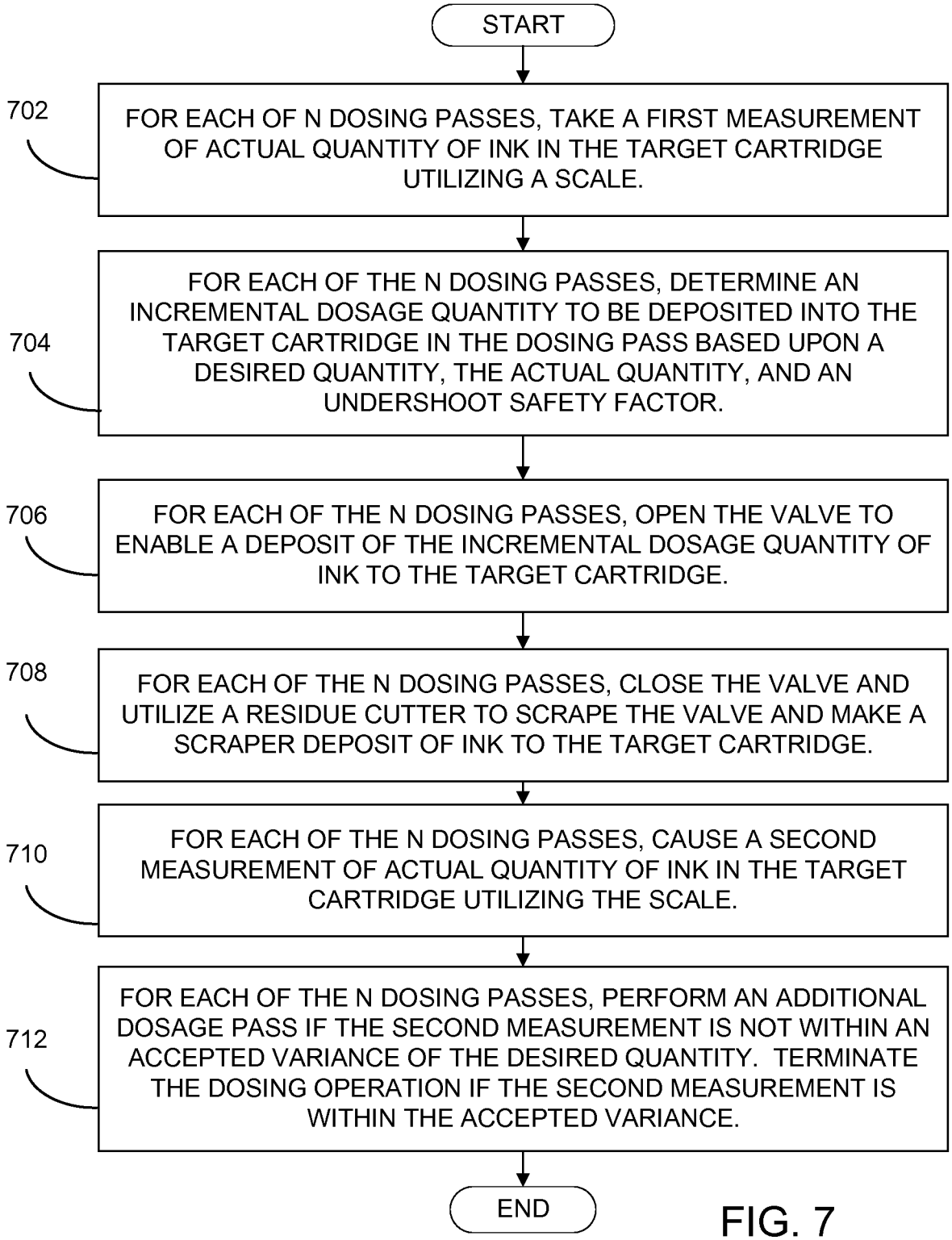
FIG. 7 illustrates a flow diagram of implementation of an example of a method for ink dosing.

FIG. 7 illustrates a flow diagram of implementation of a method for ink dosing. In discussing FIG. 7, reference may be made to the components depicted in FIGS. 1 and 3. Such reference is made to provide contextual examples and not to limit the manner in which the method depicted by FIG. 7 may be implemented. For each of n dosing passes, take a first measurement of actual quantity of ink in the target cartridge utilizing a scale (block 702). Referring back to FIGS. 1 and 3, first measurement engine 104 (FIG. 1) or first measurement module 304 (FIG. 3), when executed by processing resource 340, may be responsible for implementing block 702.

For each of the n dosing passes, determine an incremental dosage quantity to be deposited into the target cartridge in the dosing pass based upon a desired quantity, the actual quantity, and an undershoot safety factor (block 704). Referring back to FIGS. 1 and 2, incremental dosage quantity engine 106 (FIG. 1) or incremental dosage quantity module 306 (FIG. 3), when executed by processing resource 340, may be responsible for implementing block 704.

Continuing at FIG. 7, for each of the n dosing passes, open the valve to enable a deposit of the incremental dosage quantity of ink to the target cartridge (block 706). Referring back to FIGS. 1 and 3, valve engine 108 (FIG. 1) or valve module 308 (FIG. 3), when executed by processing resource 340, may be responsible for implementing block 706.

For each of the n dosing passes, close the valve and utilize a residue cutter to scrape the valve and make a scraper deposit of ink to the target cartridge (block 708). Referring back to FIGS. 1 and 3, scraper engine 110 (FIG. 1) or scraper module 310 (FIG. 3), when executed by processing resource 340, may be responsible for implementing block 708.

Continuing at FIG. 7, for each of the n dosing passes, cause a second measurement of actual quantity of ink in the target cartridge utilizing the scale (block 710). Referring back to FIGS. 1 and 3, second measurement engine 112 (FIG. 1) or second measurement module 312 (FIG. 3), when executed by processing resource 340, may be responsible for implementing block 710.

For each of the n dosing passes, perform an additional dosage pass if the second measurement is not within an accepted variance of the desired quantity. Terminate the dosing operation if the second measurement is within the accepted variance (block 712). Referring back to FIGS. 1 and 3, assessment engine 114 (FIG. 1) or assessment module 314 (FIG. 3), when executed by processing resource 340, may be responsible for implementing block 712.

FIGS. 1, 2, 3, 4, 5A, 5B, 6, and 7 aid in depicting the architecture, functionality, and operation of various examples. In particular, FIGS. 1, 2, 3, 4, 5A, 5B, and 6 depict various physical and logical components. Various components are defined at least in part as programs or programming. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function(s). Examples can be realized in a memory resource for use by or in connection with a processing resource. A "processing resource" is an instruction execution system such as a computer/processor based system or an ASIC (Application Specific Integrated Circuit) or other system that can fetch or obtain instructions and data from computer-readable media and execute the instructions contained therein. A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

Although the flow diagram of FIG. 7 shows specific orders of execution, the order of execution may differ from that which is depicted. For example, the order of execution of two or more blocks or arrows may be scrambled relative to the order shown. Also, two or more blocks shown in succession may be executed concurrently or with partial concurrence. Such variations are within the scope of the present disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive. The terms "first", "second", "third" and so on in the claims merely distinguish different elements and, unless otherwise stated, are not to be specifically associated with a particular order or particular numbering of elements in the disclosure.

What is claimed is:

1. A system for accurate dosing of high viscosity ink into a removable target cartridge, comprising:
   - a valve for releasing ink from a removable source cartridge into a removable target cartridge;
   - a residue cutter;
   - a scale;
   - a first measurement engine to, for each of n dosing passes, take a first measurement of actual quantity of ink in the target cartridge utilizing the scale;
   - an incremental dosage module, to for each of the n dosing passes, determine an incremental dosage quantity to be deposited into the target cartridge in the dosing pass based upon a desired quantity, the actual quantity, and an undershoot safety factor;
   - a valve engine, to for each of the n dosing passes, open the valve to enable a deposit of the incremental dosage quantity of ink to the target cartridge;
   - a scraper engine, to for each of the n dosing passes, close the valve and utilize the residue cutter to scrape the valve and make a scraper deposit of ink to the target cartridge;
   - a second measurement engine, to for each of the n dosing passes, cause a second measurement of actual quantity of ink in the target cartridge utilizing the scale; and
   - an assessment engine to, for each of the n dosing passes, perform an additional dosage pass if the second measurement is not within an accepted variance of the desired quantity.

2. The system of claim 1, wherein residue cutter includes a rotatable member situated beneath the valve, the member rotatable 180 degrees so as to achieve positions including a scraping position and residue drop position.

3. The system of claim 2, wherein the rotatable member is a wire member having an "S" shape.

4. The system of claim 1, further comprising a pneumatic piston to actuate the rotatable member.

5. The system of claim 1, further comprising an imaging oil tube situated adjacent to the rotatable member, the imaging oil tube for applying imaging oil to the rotatable member to remove dried ink.

6. The system of claim 1, wherein the removable source cartridge is a first source cartridge, and further comprising a carousel for alternatively moving the first source cartridge and a second source cartridge into alignment with the valve such that ink may be alternatively released from the first and second source cartridges through the valve into the removable target cartridge.

7. A method for accurate dosing of high viscosity ink into a removable target cartridge, comprising:

receiving data indicative of a desired quantity of ink to be deposited from a removable source cartridge into a removable target cartridge;

performing a dosing operation by, for each of n dosing passes, causing a first measurement of an actual quantity of ink in the target cartridge utilizing a scale;

determining an incremental dosage quantity to be deposited from the source cartridge into the target cartridge in the dosing pass based upon the desired quantity, the actual quantity, and an undershoot safety factor;

opening a valve to enable a pressure deposit of the incremental dosage quantity of ink from the source cartridge to the target cartridge;

closing the valve and utilizing a residue cutter with a rotatable member to scrape the valve and thereby make a scraper deposit of ink to the target cartridge;

causing a second measurement of actual quantity of ink in the target cartridge utilizing the scale;

performing an additional dosage pass responsive to a determination the second measurement is not within an accepted variance of the desired quantity; and terminating the dosing operation responsive to a determination the measurement is within the accepted variance.

8. The method of claim 7, wherein the amount of the undershoot safety factor is defined for each dosing pass by a logarithmic function, wherein according to such function as incremental dosage quantity increases an associated undershoot safety factor to be applied decreases.

9. The method of claim 7, wherein the rotatable member is rotated 180 degrees to achieve a first position that is a scraping position and a second position that is a dried ink drop position.

10. The method of claim 7, wherein the rotatable member is a wire member having an "S" shape.

11. The method of claim 7, further comprising receiving a spot color request, calculating the desired quantity of constituent inks based upon mixing formulation for the spot color, and causing a dosing operation for each of the constituent inks.

12. A memory resource storing instructions that when executed are to cause a processing resource to enable accurate dosing of high viscosity ink into a removable target cartridge, comprising:

a desired quantity module that when executed causes an access of data indicative of a desired quantity of ink to be deposited into a removable target cartridge;

a first measurement module that when executed causes taking of a first measurement of actual quantity of ink in the target cartridge utilizing a scale;

an incremental dosage quantity module that when executed causes determination of an incremental dosage quantity be deposited into the target cartridge in a dosing pass based upon the desired quantity, the actual quantity, and an undershoot safety factor;

a valve module that when executed causes opening of a valve to enable a pressure deposit of the incremental dosage quantity of ink to the target cartridge;

a scraper module that when executed causes closing of the valve and utilization of a residue cutter to scrape the valve and thereby make a scraper deposit of ink to the target cartridge;

a second measurement module that when executed causes a second measurement of actual quantity of ink in the target cartridge utilizing the scale;

an assessment module that when executed causes performing of an additional dosage pass if the second measurement is not within an accepted variance of the desired quantity, and to discontinue making of dosing passes if the second measurement is within the accepted variance.

13. The memory resource of claim 12, further comprising a formulation module that when executed causes calculation of the desired quantity of ink according to a specified spot color.

14. The memory resource of claim 12, wherein the scraper module when executed causes the residue cutter to scrape the valve by causing the residue cutter to make a first rotation of approximately 90 degrees in a first rotational direction, followed by a second rotation of approximately 90 degrees in a reverse second rotational direction.

15. The memory resource of claim 12, wherein the scraper module when executed causes the residue cutter to pause for at least one second between the first rotation and the reverse second rotation, so as to encourage dried ink to drop off the residue cutter during the pause period.

* * * * *